US009937720B2

(12) United States Patent
Nakano et al.

(10) Patent No.: US 9,937,720 B2
(45) Date of Patent: Apr. 10, 2018

(54) LIQUID DROPLET EJECTING APPARATUS

(71) Applicant: SEIKO EPSON CORPORATION, Tokyo (JP)

(72) Inventors: Shuichiro Nakano, Matsumoto (JP); Hidemasa Kanada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/411,694

(22) Filed: Jan. 20, 2017

(65) Prior Publication Data

US 2017/0210155 A1 Jul. 27, 2017

(30) Foreign Application Priority Data

Jan. 22, 2016 (JP) ..... 2016-010392

(51) Int. Cl.

| | |
|---|---|
| ***B41J 2/165*** | (2006.01) |
| ***B41J 2/175*** | (2006.01) |
| ***B41J 11/00*** | (2006.01) |
| ***B41J 29/377*** | (2006.01) |
| ***B41J 29/38*** | (2006.01) |

(52) U.S. Cl.

CPC ..... *B41J 2/165* (2013.01); *B41J 2/175* (2013.01); *B41J 2/17509* (2013.01); *B41J 11/002* (2013.01); *B41J 29/377* (2013.01); *B41J 29/38* (2013.01)

(58) Field of Classification Search

CPC ..... B41J 2/165; B41J 2/175

See application file for complete search history.

(56) References Cited

U.S. PATENT DOCUMENTS

| | | | | |
|---|---|---|---|---|
| 2013/0044171 | A1 | 2/2013 | Sasaki et al. | |
| 2013/0050370 | A1* | 2/2013 | Sasaki | B41J 11/002 347/102 |
| 2014/0152745 | A1* | 6/2014 | Park | B41J 2/1752 347/86 |
| 2015/0022603 | A1 | 1/2015 | Sasaki et al. | |

FOREIGN PATENT DOCUMENTS

| | | | |
|---|---|---|---|
| JP | 07-076093 | A | 3/1995 |
| JP | 2002-059568 | A | 2/2002 |
| JP | 2002321345 | A * | 11/2002 |
| JP | 2013-039721 | A | 2/2013 |
| JP | 2013-043290 | A | 3/2013 |
| JP | 2015-223825 | A | 12/2015 |

* cited by examiner

*Primary Examiner* — Kristal Feggins
*Assistant Examiner* — Kendrick Liu
(74) *Attorney, Agent, or Firm* — Workman Nydegger

(57) ABSTRACT

A printing device includes a heating section capable of heating paper P transported over a support platform, a head unit that is disposed at a position facing the support platform with a gap therebetween, and that is capable of rotating about a rotation shaft extending along width direction X, and a head cooling unit that is capable of cooling the head unit. The head unit is provided with a first head that includes a nozzle capable of ejecting ink, a second head that includes a nozzle capable of ejecting ink, and a third head that includes a nozzle capable of ejecting ink, with the heads provided around a rotation direction of the head unit with gaps between one another. When one head out of the respective heads faces the paper P, another head out of the respective heads can be made to face the head cooling unit.

3 Claims, 7 Drawing Sheets

LIQUID DROPLET EJECTING APPARATUS

BACKGROUND

1. Technical Field

The present disclosure relates to a liquid droplet ejecting apparatus capable of switching a head that faces a medium by rotating a head unit provided with plural heads that eject liquid droplets onto the medium.

2. Related Art

To date, known liquid droplet ejecting apparatuses of this type are provided with a head unit having two heads that eject ink (liquid droplets) onto a medium, and with a maintenance unit that performs maintenance such as wiping or capping of the heads (for example, see JP-A-2002-59568). Such liquid droplet ejecting apparatuses can record on the medium and perform maintenance on the heads in parallel by using rotation of the head unit to switch positions of two heads so as to alternate between a recording position ejecting liquid droplets onto the medium, and a maintenance position facing the maintenance unit.

However, in some cases, the medium is heated in existing liquid droplet ejecting apparatuses in order to dry (fix) the liquid droplets deposited on the medium. In such cases, the temperature of nozzles of the head rises when heat of the medium is conducted to the head facing the medium, and ejection defects such as clogging of the nozzles may arise in the head facing the medium as a result.

SUMMARY

An advantage of some aspects of the invention is to provide a liquid droplet ejecting apparatus capable of suppressing ejection defects from occurring.

A method to solve the above problem and operation and advantageous effects thereof are described below.

In order to solve the above problem, a liquid droplet ejecting apparatus includes a heating section capable of heating a medium transported over a support platform, a head unit that is disposed at a position facing the support platform with a gap therebetween, and that is capable of rotating about a rotation shaft extending along a direction intersecting a transport direction of the medium, and a head cooling unit capable of cooling the head unit. The head unit is provided with plural heads that each include a nozzle capable of ejecting liquid droplets. The heads are provided around a rotation direction of the head unit with gaps between one another, such that when one head out of the plural heads faces the medium, another head out of the plural heads can be made to face the head cooling unit.

According to the configuration above, heat of the heating section is, for example, conducted to a head that ejects liquid droplets onto the medium, and when the temperature of the head has risen, the head unit rotates. That head is then cooled by being made to face the head cooling unit, while another head faces the medium. Due to the head unit being rotated, the head having a raised temperature is rapidly cooled while ejection of liquid droplets onto the medium continues. Accordingly, ejection defects such as nozzle clogging, caused by raised temperature of the head, can be suppressed from occurring.

Moreover, the liquid droplet ejecting apparatus is preferably configured such that all of the plural heads can be made to face the head cooling unit by rotating the head unit.

According to this configuration, whichever of the heads in the head unit has a raised temperature, that head can be cooled by the head cooling unit. Accordingly, ejection defects can be suppressed from occurring in all of the heads of the head unit.

Moreover, the liquid droplet ejecting apparatus is preferably configured such that the head cooling unit is disposed at a position higher than the head unit, and the nozzle of the head facing the head cooling unit is upwardly open.

According to this configuration, each surface of the liquid inside the nozzles of the head facing the head cooling unit forms a meniscus curve that is bowed inward due to the weight of the liquid. This enables the liquid inside the nozzle to be suppressed from depositing on the head cooling unit.

Moreover, the liquid droplet ejecting apparatus is preferably configured further including a liquid supply source capable of supplying the liquid to the head unit, and a flexible supply flow path that connects the head unit to the liquid supply source, wherein the head unit is capable of rotating in both directions about the rotation shaft.

In cases where the head unit is only allowed to rotate in one direction, even if the supply flow paths were to be made long, the supply flow paths would wind around the rotation shaft each time the head unit is rotated to cool a head with the head cooling unit, and sometimes the supply flow paths become taut and hinder rotation of the head unit, depending on how many times the head unit has rotated.

According to the configuration above, even when the supply flow paths have wound around the rotation shaft when the head unit rotates in one direction, the supply flow paths wound around the rotation shaft are restored to their former state by the head unit rotating in the opposite direction to the one direction. This enables the supply flow paths to be prevented from becoming taut and hindering the rotation of the head unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation follows regarding an exemplary embodiment in which a liquid droplet ejecting apparatus is embodied by a printing device, with reference to the drawings. In the present exemplary embodiment, the printing device is an ink jet printer that forms text or an image on paper, which serves as an example of a medium, by ejecting ink, which serves as an example of a liquid drop, onto the paper. The ink of the present exemplary embodiment is water-based resin ink that includes water in the solvent and includes a pigment made from a resin as a solute.

Figure 1:
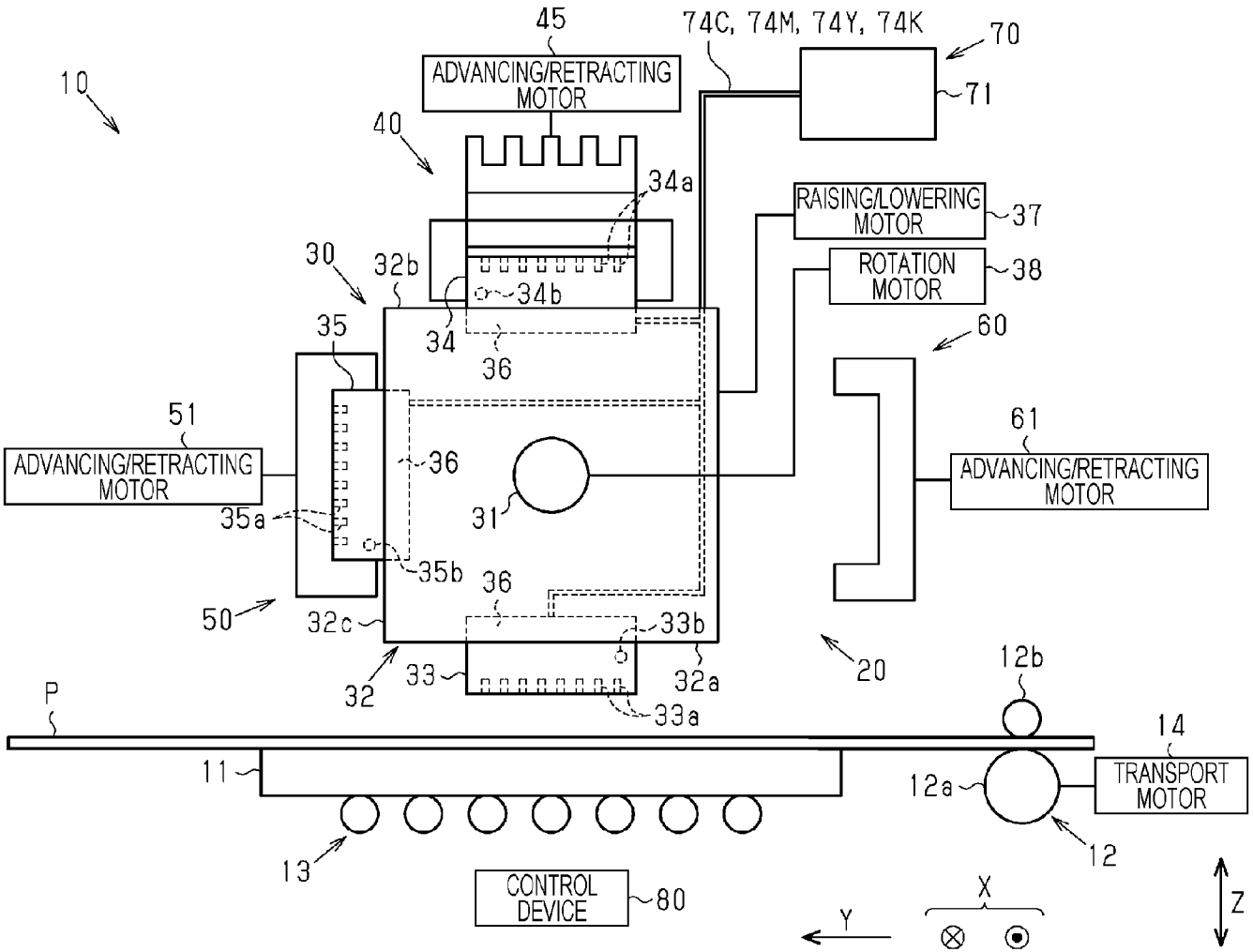
FIG. 1 is a front face schematic diagram of an exemplary embodiment of a liquid droplet ejecting apparatus.

As illustrated in FIG. 1, a printing device 10 includes a support platform 11 that supports paper P being transported, a transport roller pair 12 that transports the paper P over the support platform 11, a printing section 20 that prints on the paper P over the support platform 11, an ink supply mechanism 70 that supplies ink to the printing section 20, and a control device 80 that controls the transport roller pair 12 and the printing section 20. In the following explanation, the width direction of the paper P defines a "width direction X", the transport direction of the paper P defines a "transport direction Y", and a direction orthogonal to the width direction X and the transport direction Y defines a "height direction Z". The width direction X is an example of a direction intersecting the transport direction Y, and is orthogonal to the transport direction Y.

The support platform 11 is made from metal (for example, made from aluminum). A heating section 13 capable of heating the paper P being transported over the support platform 11 is provided below the support platform 11. A flat heater is an example of the heating section 13. The heating section 13 heats the paper P over the support platform 11 by heating the lower face of the support platform 11. This enables ink printed onto the paper P to be dried (fixed).

The transport roller pair 12 is provided further to the upstream side in the transport direction Y than the support platform 11. The transport roller pair 12 includes a driven roller 12*a* that is rotated by a transport motor 14 with the width direction X as an axial direction, and a following roller 12*b* that rotates by following with the width direction X as an axial direction.

The printing section 20 includes a head unit 30 that extends in the width direction X and that is capable of rotating about a rotation shaft, a head cooling unit 40 capable of cooling the head unit 30, and a first cap 50 and a second cap 60 that prevent the ink of the head unit 30 from drying.

The head unit 30 is disposed above the support platform 11 at a position facing the support platform 11 with a gap therebetween, and is what is known as a line head capable of simultaneous ink ejections across the width direction X. The head unit 30 includes a shaft 31 that extends in the width direction X and that configures a rotation shaft, and a head support section 32 attached to the shaft 31 so as to be rotatable as a unit with the shaft 31. The head support section 32 is formed with a square shape as viewed from a side face thereof. A first head 33, a second head 34, and a third head 35 are respectively provided along three faces 32*a*, 32*b*, 32*c* present around the rotation direction of the head support section 32 (the head unit 30) when the head support section 32 is viewed from a side face thereof. The second head 34 is provided at a position separated from the first head 33 by 180° around the shaft 31, and the third head 35 is provided at a position separated from the first head 33 and the second head 34 by 90° around the shaft 31. In FIG. 1, the first head 33 faces the support platform 11, the second head 34 faces the head cooling unit 40, and the third head 35 is housed in the first cap 50.

Numerous nozzles 33*a*, capable of ejecting ink, are formed in the first head 33. Moreover, a thermistor 33*b* for detecting the temperature of the first head 33 is attached to the first head 33. The second head 34 and the third head 35 are similarly formed with numerous nozzles 34*a*, 35*a*, and thermistors 34*b*, 35*b* for detecting the temperature of the second head 34 and the third head 35 are attached to the second head 34 and the third head 35.

A pressure adjusting mechanism 36 is provided to the head unit 30, and the pressure adjusting mechanism 36 adjusts the pressures inside the nozzles 33*a* to 35*a* of the respective heads 33 to 35 to a specific negative pressure so that leaking of ink from the nozzles 33*a* to 35*a* is suppressed. The pressure adjusting mechanism 36 is provided for each of the heads 33 to 35 further toward the upstream side of a supply flow path, which is a flow path supplying ink from the ink supply mechanism 70 to each of the heads 33 to 35, than each of the heads 33 to 35. The pressure adjusting mechanism 36 includes a pressure adjusting valve (not illustrated in the drawings). When the pressure to the further downstream side of the supply flow path than the pressure adjusting valve has dropped lower than a specific negative pressure due to ink consumption, the pressure adjusting valve opens to allow ink to be supplied to the downstream side. The pressure adjusting valve also opens when the pressure further to the downstream side than the pressure adjusting valve rises to a specific negative pressure due to ink being supplied. Thus, the pressure adjusting mechanism 36 maintains the pressure of the ink in the supply flow path at a specific negative pressure, from the pressure adjusting valve to the nozzles 33*a* to 35*a* of the respective heads 33 to 35.

A raising/lowering motor 37 for raising and lowering the head support section 32 (the shaft 31) in the height direction Z, and a rotation motor 38 for rotating the shaft 31 are provided to the head unit 30. The raising/lowering motor 37 moves the head support section 32 between a printing position that is a position where one head out of the respective heads 33 to 35 of the head unit 30 faces the support platform 11 and prints on the paper P, and a retracted position that is a position separated from and above the printing position. The raising/lowering motor 37 is coupled to the head support section 32 through a mechanism (not illustrated in the drawings) that converts rotational motion into linear motion, such as a rack and pinion mechanism. When the head support section 32 is in the retracted position, the rotation motor 38 rotates the head unit 30 about the rotation shaft (the shaft 31). The rotation motor 38 is coupled to the shaft 31 through a reduction gear (not illustrated in the drawings).

Note that the head support section 32 may be attached so as to be rotatable with respect to the shaft 31. In such cases, the rotation motor 38 is coupled to the head support section 32 through the reduction gear (not illustrated in the drawings), and the shaft 31 does not rotate.

The head cooling unit 40 is capable of cooling the head unit 30 more rapidly than natural cooling. The head cooling unit 40 is disposed above the head unit 30, namely, at the opposite side of the support platform 11 with respect to the head unit 30. Note that natural cooling of the head unit 30 refers to lowering the temperature of the head unit 30 by rotating the head unit 30 to separate the head facing the support platform 11 from the support platform 11 (the heating section 13).

The head cooling unit 40 is provided with an advancing/retracting motor 45 that moves the head cooling unit 40 between a cooling position that is positioned above a head out of the respective heads 33 to 35 and that cools the head by covering the head, and a retracted position that is higher than and separated from the cooling position. The advancing/retracting motor 45 is coupled to the head cooling unit 40 through a mechanism (not illustrated in the drawings) that converts rotational motion into linear motion, such as a rack and pinion mechanism.

The first cap 50 is disposed facing the head unit 30 in a position further to the downstream side in the transport direction Y than the head unit 30, and the second cap 60 is disposed facing the head unit 30 in a position further to the upstream side in the transport direction Y than the head unit 30. The first cap 50 and the second cap 60 are each capable of covering the respective heads 33 to 35. Moreover, the first cap 50 and the second cap 60 are each provided with a housing mechanism (not illustrated in the drawings) that houses waste ink ejected from the respective heads 33 to 35 into the first cap 50 and the second cap 60. This enables the printing device 10 to perform maintenance such as cleaning and flushing when any of the respective heads 33 to 35 are covered by the first cap 50 or the second cap 60.

The first cap 50 is provided with an advancing/retracting motor 51 that moves the first cap 50 between a maintenance position at which one head out of the respective heads 33 to 35 faces the first cap 50 in the transport direction Y and is covered by the first cap 50, and a retracted position separated from the maintenance position toward the downstream side in the transport direction Y. The advancing/retracting motor 51 is coupled to the first cap 50 through a mechanism (not illustrated in the drawings) that converts rotational motion into linear motion such as a rack and pinion mechanism. Note that in FIG. 1, the first cap 50 is disposed in the maintenance position.

The second cap 60 is provided with an advancing/retracting motor 61 that moves the second cap 60 between a maintenance position at which a head out of the respective heads 33 to 35 faces the second cap 60 in the transport direction Y and is covered by the second cap 60, and a retracted position separated from the maintenance position toward the upstream side in the transport direction Y. The advancing/retracting motor 61 is coupled to the second cap 60 through a mechanism (not illustrated in the drawings) that converts rotational motion to linear motion such as a rack and pinion mechanism. Note that in FIG. 1, the second cap 60 is disposed in the retracted position.

Figure 2:
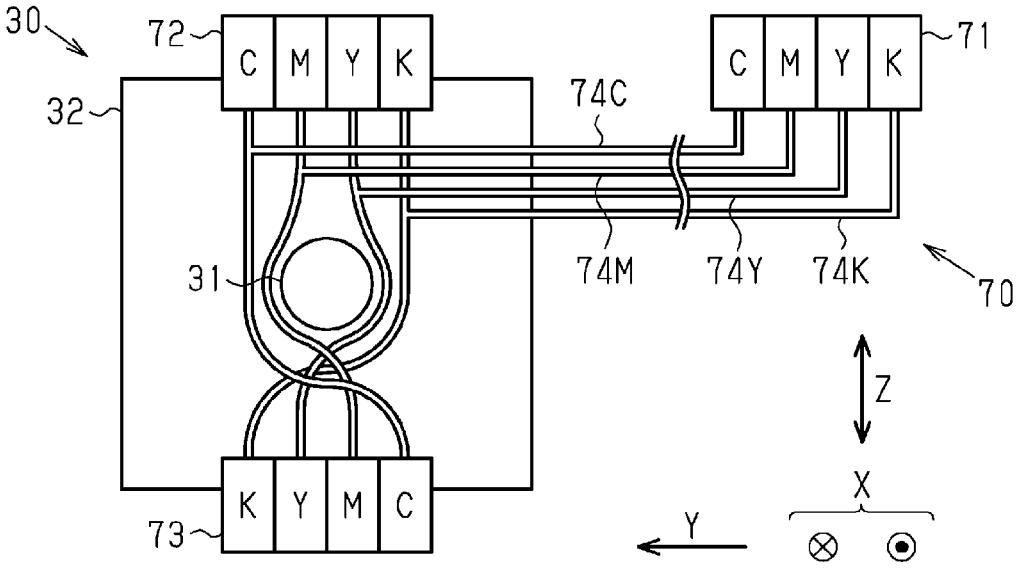
FIG. 2 is a side face schematic diagram of the liquid droplet ejecting apparatus of FIG. 1.

As illustrated in FIG. 2, the ink supply mechanism 70 supplies, for example, inks of four colors: cyan (C), magenta (M), yellow (Y), and black (K), to the head unit 30. The ink supply mechanism 70 includes an ink tank 71 that is an example of a liquid supply source disposed and fixed at a position separated from the head unit 30, and two sub-tanks 72, 73 provided at a width direction X side face of the head unit 30. The ink tank 71 and the sub-tanks 72, 73 are connected together by four flexible supply flow paths 74C, 74M, 74Y, 74K. The flexible supply flow paths 74C connect a tank that stores cyan ink in the ink tank 71 to tanks that store cyan ink in the sub-tanks 72, 73. The supply flow path 74M connects a tank that stores magenta ink in the ink tank 71 to tanks that store magenta ink in the sub-tanks 72, 73. The supply flow path 74Y connects a tank that stores yellow ink in the ink tank 71 to tanks that store yellow ink in the sub-tanks 72, 73. The supply flow path 74K connects a tank that stores black ink in the ink tank 71 to tanks that store black ink in the sub-tanks 72, 73. The ink of the sub-tanks 72, 73 is supplied to each of the heads 33 to 35 (not illustrated in FIG. 2, see FIG. 1) via a supply flow path and the pressure adjusting mechanism 36 provided to the head support section 32 (see FIG. 1). Note that the inks are not limited to four colors, and there may be any out of one to three colors, or five or more colors. The number of supply flow paths is changed according to the number of ink colors.

Figure 3:
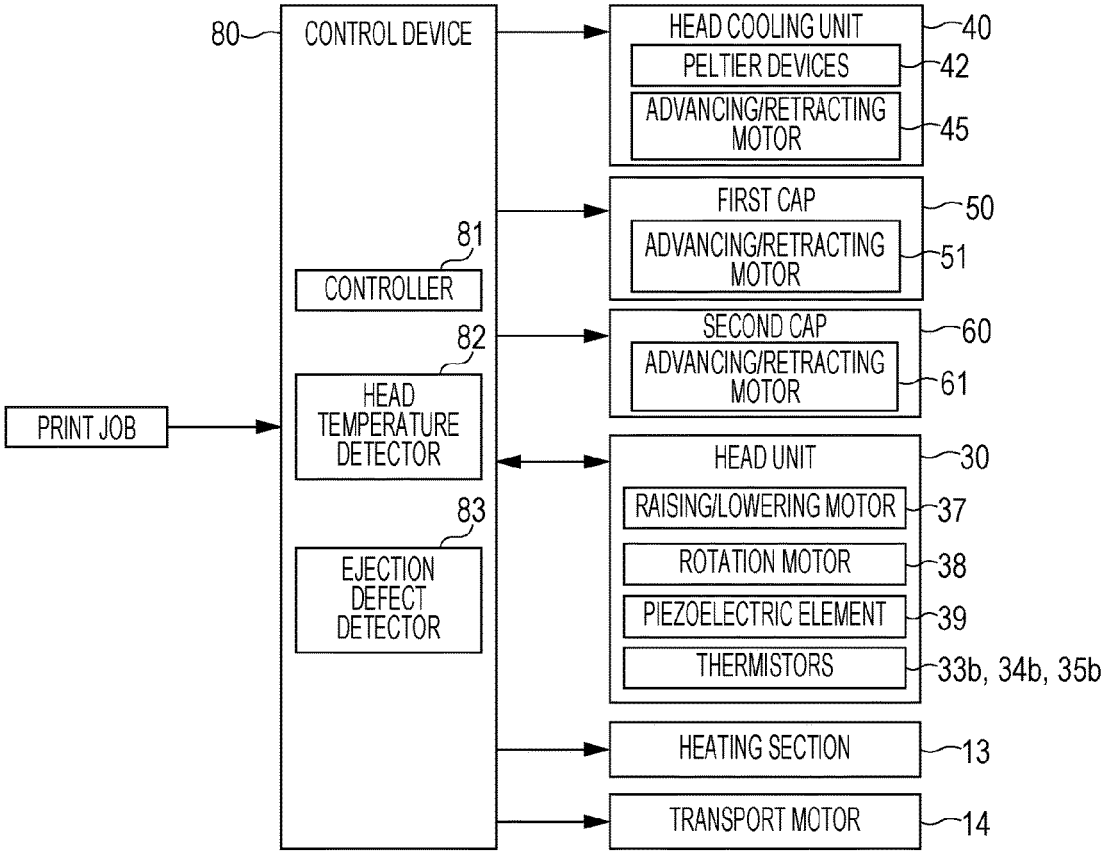
FIG. 3 is a block diagram illustrating an electrical configuration of a liquid droplet ejecting apparatus.

As illustrated in FIG. 3, the control device 80 receives a print job and controls the head unit 30, the head cooling unit 40, the first cap 50, the second cap 60, the heating section 13, and the transport motor 14 based on the received print job. The control device 80 includes a controller 81, a head temperature detector 82, and an ejection defect detector 83.

When the controller 81 has received a print job, the controller 81 heats the support platform 11 using the heating section 13 (see FIG. 1), and transports the paper P, which is pinched between the transport roller pair 12, over the support platform 11 by causing the transport motor 14 to rotate. The controller 81 then prints on the paper P by controlling a piezoelectric element 39 of the head unit 30 to eject ink onto the paper P above the support platform 11 from the head facing the support platform 11 out of the respective heads 33 to 35 (see FIG. 1).

The head temperature detector 82 receives the temperature detected by the thermistors 33*b* to 35*b* of the respective heads 33 to 35 and calculates the temperature of the respective heads 33 to 35 based on the received detected temperatures. The head temperature detector 82 transmits the calculated temperature of the respective heads 33 to 35 to the controller 81.

The ejection defect detector 83 acquires a vibration pattern of a residual vibration of a vibrating plate (not illustrated in the drawings) that causes ink to be ejected from the nozzles 33*a* to 35*a* of the respective heads 33 to 35 by deforming based on driving of the piezoelectric element 39. The ejection defect detector 83 then determines nozzles having an ejection defect amongst the nozzles 33*a* to 35*a* based on the acquired vibration pattern. Primary causes of ejection defects include, for example, cases where ink in the vicinity of the nozzles 33*a* to 35*a* is thickening and solidifying due to drying, cases of bubble contamination at cavities (not illustrated in the drawings) configuring the ink supply flow paths in the respective heads 33 to 35, and cases where foreign matter has been deposited in the vicinity of the respective nozzles 33*a* to 35*a*. The period of the residual vibration of the vibration plate is lengthened or shortened due to the occurrence of such ejection defects, compared to the period of residual vibration in cases where the nozzles 33*a* to 35*a* are ejecting normally. Thus, the ejection defect detector 83 determines that the nozzle 33*a* to 35*a* corresponding to the vibration plate has an ejection defect when the period of the residual vibration of a vibration plate in the nozzles 33*a* to 35*a* is outside of a normal range for the period of residual vibration when the nozzles 33*a* to 35*a* eject.

Figure 4A:
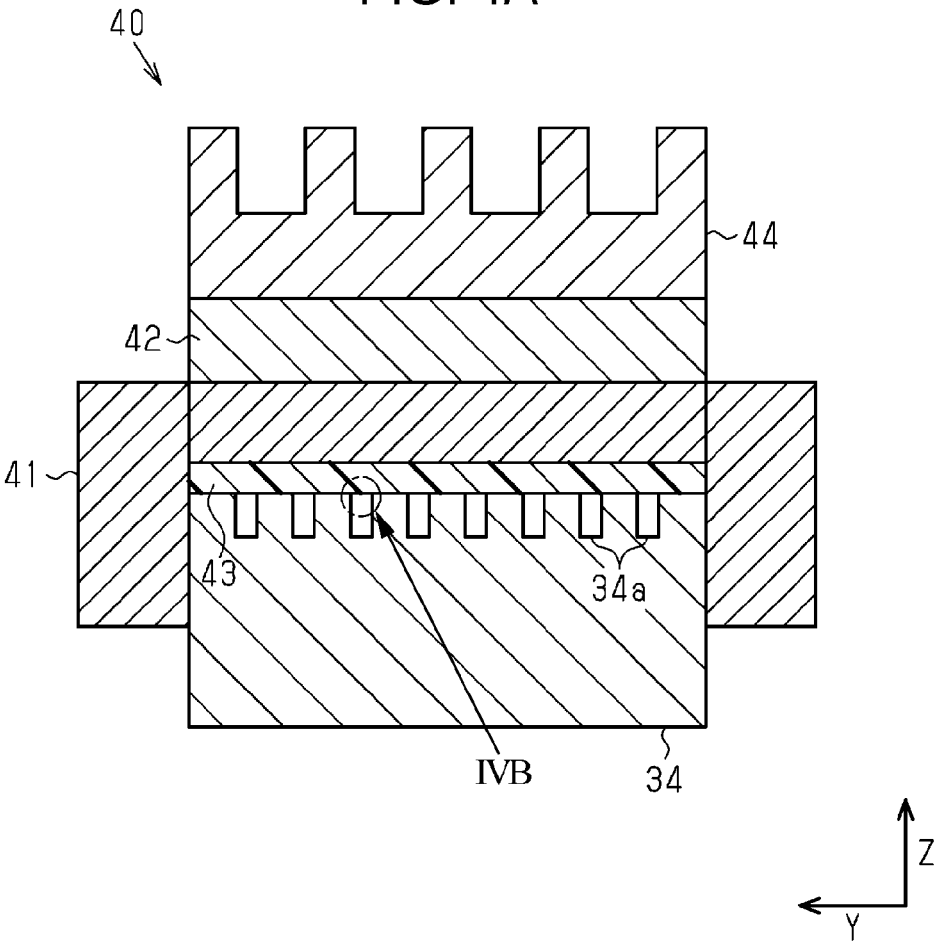
FIG. 4A is a cross-section schematic diagram of a head cooling unit of the liquid droplet ejecting apparatus.
Figure 4B:
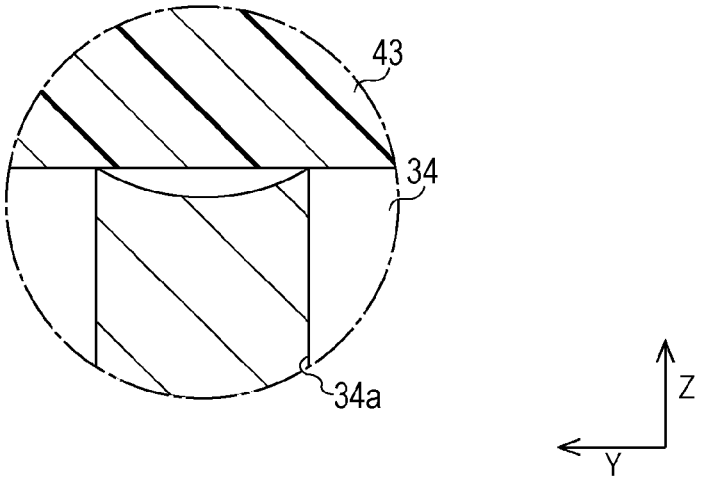
FIG. 4B is an enlarged diagram of the dashed circle of FIG. 4A.

Next, explanation follows regarding a detailed configuration of the head cooling unit 40, with reference to FIG. 4A and FIG. 4B.

As illustrated in FIG. 4A, the head cooling unit 40 includes a cap 41 made from metal (for example, made from aluminum). The cap 41 may, for example, be formed from a metal that exhibits excellent heat dissipation such as copper. The cap 41 is formed in the shape of a recess that is recessed inward toward the top. Plural Peltier devices 42 are attached to an upper face that forms an outer face of the cap 41, and an elastic portion 43 for improving close contact with the head housed in the cap 41 is attached to a lower face that forms an inner face of the cap 41. The elastic portion 43 is preferably formed from a material having excellent elasticity and thermal conductivity such as a silicone. A heatsink 44 is provided to an upper face of the Peltier devices 42.

The plural Peltier devices 42 are, for example, disposed across the entire upper face of the cap 41. The Peltier devices 42 are provided such that the cap 41 side is the heat absorbing side and the heatsink 44 side is the heat dissipating side. Thus, when one head out of the respective heads 33 to 35 (the second head 34 in FIG. 4A) is housed in the cap 41 in a state of close contact with the elastic portion 43, the second head 34 absorbs heat through the elastic portion 43 and also dissipates heat to the heatsink 44 due to electric power being supplied to the Peltier devices 42. The second head 34 is thereby cooled. As illustrated by the enlarged diagram of inside the dashed circle of FIG. 4B, the second head 34 housed in the cap 41 is open toward the upper side of the nozzle 34*a*. Ink, represented by shading, inside the nozzle 34*a* thereby forms a meniscus that is recessed inward toward the bottom due to its own weight.

Next, explanation follows regarding the rotating movement of the head unit 30, with reference to FIG. 5 to FIG. 10. The rotating movement of the head unit 30 is controlled by the controller 81 (see FIG. 3). Moreover, in FIG. 5 to FIG. 10, shadings of different density are applied to the respective heads 33 to 35 such that the first head 33, the second head 34, and the third head 35 are easily recognized. In the following explanation, the respective motors allocated with reference numerals and serving as drive sources represent the respective motors of FIG. 1 and FIG. 3.

Figure 5:
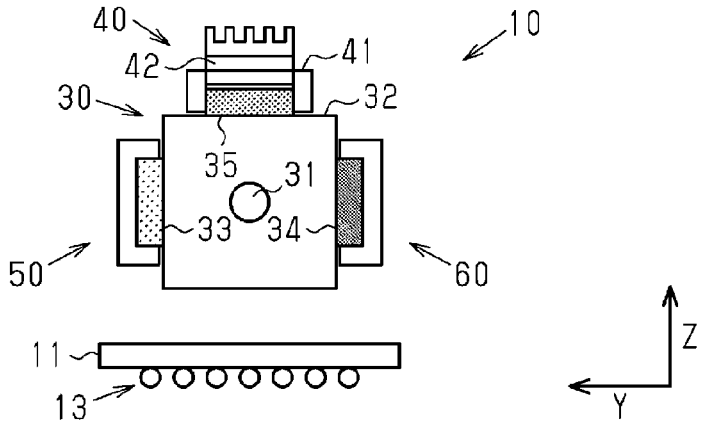
FIG. 5 is a front face schematic diagram of a liquid droplet ejecting apparatus illustrating a head unit before printing starts.

As illustrated in FIG. 5, at a non-printing period such as before a print job is received, the head unit 30 is rotationally positioned such that the first head 33 faces the first cap 50, the second head 34 faces the second cap 60, and the third head 35 faces the cap 41 of the head cooling unit 40. Moreover, the second cap 60 and the first cap 50 are in maintenance positions and the head cooling unit 40 is in the cooling position. Thus, the first head 33 is housed in the first cap 50, the second head 34 is housed in the second cap 60, and the third head 35 is housed in the cap 41. Moreover, the head unit 30 is in the printing position. Note that the head unit 30 may be in the retracted position.

Next, when the printing device 10 has received a print job, the head unit 30, the head cooling unit 40, the first cap 50, and the second cap 60 move such that, for example, the first head 33 faces the support platform 11.

Figure 6:
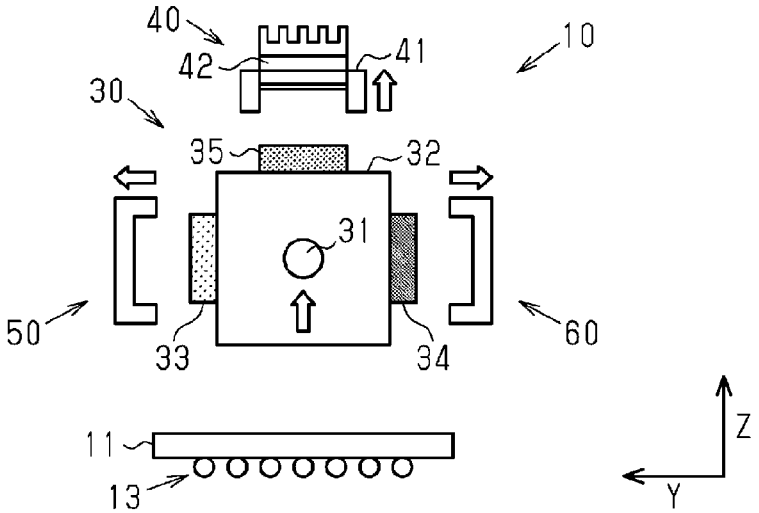
FIG. 6 is a front face schematic diagram of a liquid droplet ejecting apparatus illustrating a state in which raising and lowering and rotation of a head unit are allowed.
Figure 7:
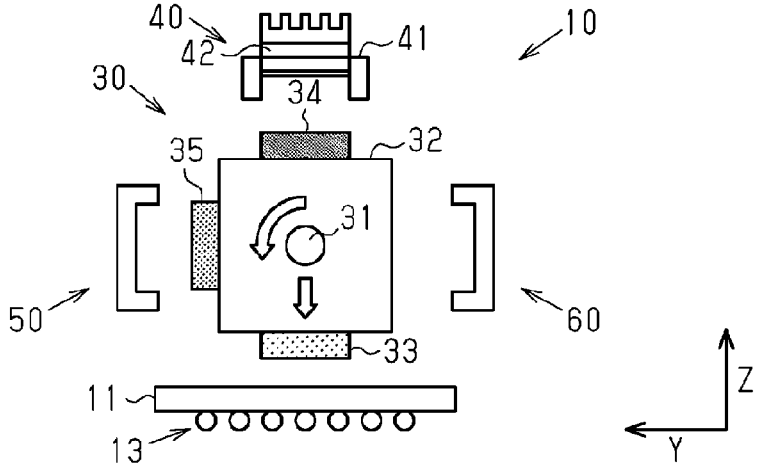
FIG. 7 is a front face schematic diagram of a liquid droplet ejecting apparatus illustrating a state in which a head unit has rotated.
Figure 8:
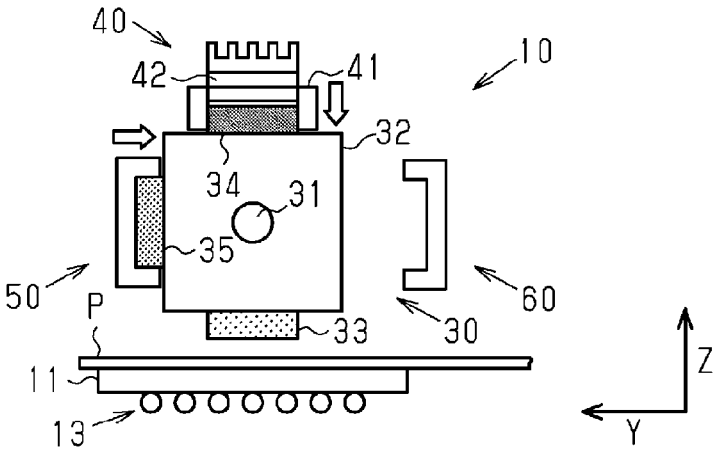
FIG. 8 is a front face schematic diagram of a liquid droplet ejecting apparatus illustrating a state enabling printing by a first head.

More specifically, as illustrated in FIG. 6, the first cap 50 is moved from the maintenance position to the retracted position by the advancing/retracting motor 51, the second cap 60 is moved from the maintenance position to the retracted position by the advancing/retracting motor 61, and the cap 41 is moved from the cooling position to the retracted position by the advancing/retracting motor 45. Moreover, the head unit 30 is raised from the printing position to the retracted position by the raising/lowering motor 37. Then, as illustrated in FIG. 7, after the head unit 30 has been rotated 90° in the counterclockwise direction about the shaft 31 by the rotation motor 38, the head unit 30 is lowered from the retracted position to the printing position by the raising/lowering motor 37. Thus, as illustrated in FIG. 7, the second head 34 faces the head cooling unit 40 and the third head 35 faces the first cap 50. However, no head faces the second cap 60. Thus, as illustrated in FIG. 8, the first cap 50 is moved from the retracted position to the maintenance position by advancing/retracting motor 51 to house the second head 34, and the cap 41 is moved from the retracted position to the cooling position by the advancing/retracting motor 45 to house the third head 35. However, the second cap 60 is kept in the retracted position. Namely, the advancing/retracting motor 61 is not driven. The head unit 30 then prints on the paper P over the support platform 11 using the first head 33.

Moreover, during printing, when the head printing on the paper P is changed from the first head 33 to the second head 34, the first cap 50 is moved from the maintenance position to the retracted position by the advancing/retracting motor 51, and the cap 41 is moved from the cooling position to the retracted position by the advancing/retracting motor 45. Then, after the head unit 30 has been raised from the printing position to the retracted position by the raising/lowering motor 37 and the head unit 30 has been rotated 180° about the shaft 31 in the clockwise direction by the rotation motor 38, the head unit 30 is lowered from the retracted position to the printing position. At this time, since the first head 33 faces the head cooling unit 40 and the third head 35 faces the second cap 60, the cap 41 is moved from the retracted position to the cooling position by the advancing/retracting motor 45 and the second cap 60 is moved from the retracted position to the maintenance position by the advancing/retracting motor 61. However, since no head faces the first cap 50, the advancing/retracting motor 51 does not drive and the first cap 50 is kept in the retracted position.

Moreover, during printing, when the head printing on the paper P is changed from the second head 34 to the third head 35, the head cooling unit 40 is moved from the cooling position to the retracted position by the advancing/retracting motor 45, and the second cap 60 is moved from the maintenance position to the retracted position by the advancing/retracting motor 61. Then, after the head unit 30 has been raised from the printing position to the retracted position by the raising/lowering motor 37, and the head unit 30 has been rotated about the shaft 31 by 90° in the clockwise direction by the rotation motor 38, the head unit 30 is lowered from the retracted position to the printing position. At this time, since the first head 33 faces the second cap 60 and the second head 34 faces the first cap 50, the second cap 60 is moved from the retracted position to the maintenance position by the advancing/retracting motor 61 and the first cap 50 is moved from the retracted position to the maintenance position by the advancing/retracting motor 51. However, since no head faces the head cooling unit 40, the advancing/retracting motor 45 does not drive, and the head cooling unit 40 is kept in the retracted position.

Note that in cases where a change from the third head 35 to the first head 33 or the second head 34 is made during printing, the rotational movement of the head unit 30 may differ as follows. In cases where a change is made from the third head 35 to the first head 33, the head unit 30 is rotated by 270° about the shaft 31 in the counterclockwise direction by the rotation motor 38. In cases where a change is made from the third head 35 to the second head 34, the head unit 30 is rotated by 90° about the shaft 31 in the counterclockwise direction by the rotation motor 38.

Figure 9:
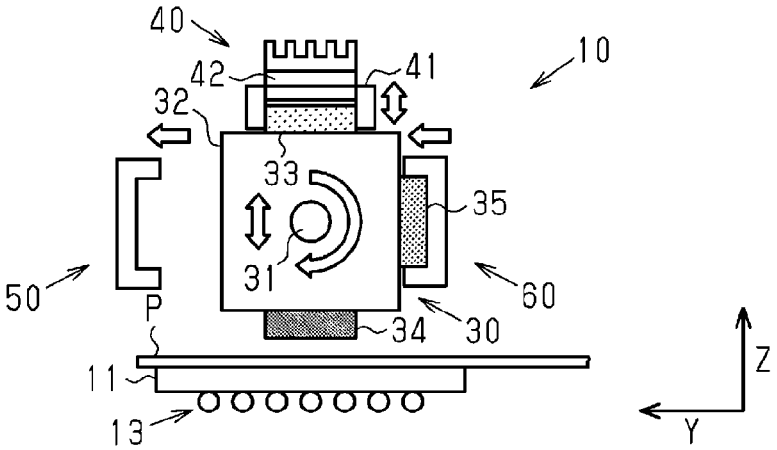
FIG. 9 is a front face schematic diagram of a liquid droplet ejecting apparatus in a state enabling printing by a second head.
Figure 10:
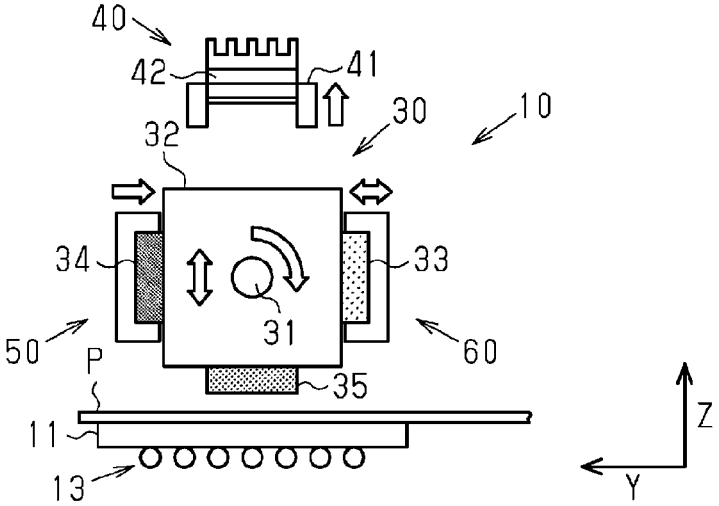
FIG. 10 is a front face schematic diagram of a liquid droplet ejecting apparatus in a state enabling printing by a third head.

When changing the respective heads 33 to 35, the head unit 30 rotates about the shaft 31 in both directions as described above, such that the supply flow paths 74C, 74M, 74Y, 74K (see FIG. 2) are not wound into spirals. Thus, when changing between the respective heads 33 to 35, the head unit 30 rotates about the shaft 31 at an angle of no more than 360° in any direction. As illustrated in FIG. 5, FIG. 8, and FIG. 9, all of the respective heads 33 to 35 can be made to face the head cooling unit 40 by rotating the head unit 30.

In resin ink printers such as the printing device 10 illustrated in FIG. 1, heat of the heating section 13 is also conducted to the head facing the paper P since the support platform 11 (the paper P) is also heated by the heating section 13. As a result, in some cases, the head facing the paper P reaches a high temperature, the resin component of the ink in the head facing the paper P hardens, and the resin component is deposited around the nozzle of the head facing the paper P. Ejection defects such as nozzle clogging may therefore occur in the head facing the paper P. The printing quality is lowered in cases where printing on the paper P uses a head in which an ejection defect has occurred.

Thus, during printing, the controller 81 (see FIG. 3) executes head change processing that changes the head printing on the paper P based on the temperature of the respective heads 33 to 35 and the state of the nozzles 33*a* to 35*a* of the respective heads 33 to 35. This head change is executed by a rotational movement of the head unit 30 as illustrated in FIG. 5 to FIG. 10. This enables printing on the paper P to be performed using a head other than the head facing the support platform 11 out of the respective heads 33 to 35 when in a state in which an ejection defect has occurred in that head. Since rotational movement of the head unit 30 is performed when in a state in which an ejection defect has a high chance of occurring in the head facing the support platform 11 out of the respective heads 33 to 35, the effect of heat from the support platform 11 (the paper P) can be suppressed by separating the head that was facing the support platform 11 from the support platform 11 (the paper P). Moreover, in cases where the head that was facing the support platform 11 is cooled by the head cooling unit 40, the head is cooled more rapidly than natural cooling, enabling the chance of an ejection defect occurring in the head to be lowered. Explanation follows regarding the sequence of such head change processing, with reference to the flowchart of FIG. 11. Note that the head change processing is repeatedly executed at specific intervals during printing.

The controller 81 first acquires the information regarding the temperature of the head printing on the paper P out of the respective heads 33 to 35 (the head facing the support platform 11) and regarding the presence or absence of ejection defects in the nozzles (step S11). The controller 81 acquires the temperature of the head from the head temperature detector 82, and ascertains the presence or absence of ejection defects in the nozzles from the ejection defect detector 83.

Next, the controller 81 determines whether or not there is an ejection defect in the nozzles in the head printing on the paper P (step S12). When the controller 81 has determined that there is no ejection defect in the nozzles of the head printing on the paper P (NO at step S12), the controller 81 determines whether or not the temperature of the head printing on the paper P is a threshold value or above (step S13). Note that one example of the threshold value is a minimum value of the temperature of the head at which the head enters a state of having a high chance of an ejection defect occurring due to the resin component of the ink in the nozzles of the head hardening. The threshold value is pre-set from experimentation or the like.

When the controller 81 has determined that there is an ejection defect in the nozzle of the head printing on the paper P (YES at step S12) or when the controller 81 has determined that the temperature of the head printing on the paper P is the threshold value or greater (YES at step S13), the head printing on the paper P is changed (step S14). The method of changing the head printing on the paper P may, for example, be a change based on a sequence predefined such that after changing to the first head 33, the second head 34, and the third head 35 in sequence, a change is made back to the first head 33, or a head out of the respective heads 33 to 35 having the lowest temperature may be used. The processing temporarily ends when the controller 81 has determined that the temperature of the head printing on the paper P is less than the threshold value (NO at step S13).

Explanation follows regarding operating of the present exemplary embodiment.

Figure 11:
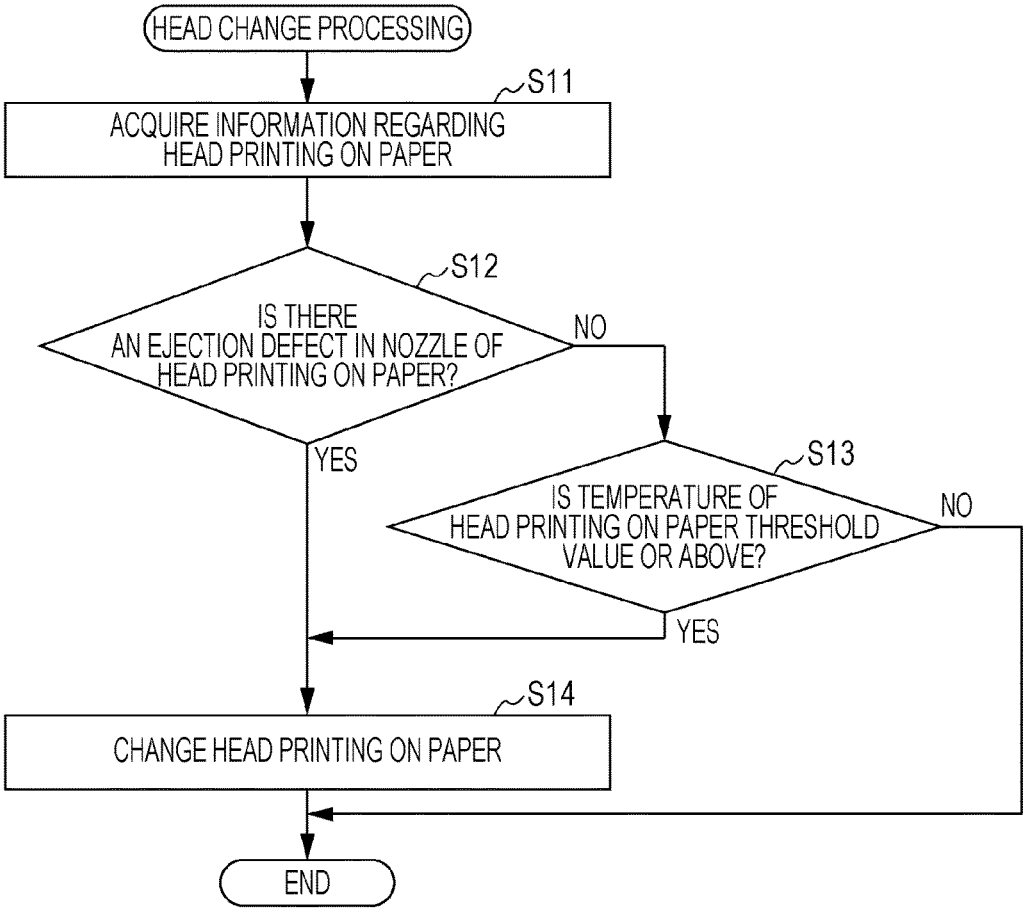
FIG. 11 is a flowchart illustrating a procedure of head change processing.

As illustrated in FIG. 8, when the first head 33 is printing on the paper P, the head change processing causes the second head 34 to print on the paper P in cases where, for example, heat of the heating section 13 causes the temperature of the first head 33 to reach the threshold value or above (step S13 of FIG. 11). In such cases, as illustrated in FIG. 9, the first head 33 having a high temperature is housed in the cap 41 of the head cooling unit 40, and the heat is dissipated (cooling performed) by driving the Peltier devices 42. This lowers the temperature of the first head 33 more rapidly than natural cooling that lowers the temperature due to separating from the paper P. However, the second head 34 that was positioned most separated from the paper P when the first head 33 was printing on the paper P has a low temperature when moved to the position facing the paper P as illustrated in FIG. 9, and the second head 34 therefore prints on the paper P in a state of having a low chance of an ejection defect occurring. Thus a head that had a high temperature is cooled by head cooling unit 40 and a head that has a low temperature prints on the paper P.

According to the present exemplary embodiment, the following advantages effects can be obtained.

(1) The head printing on the paper P out of the respective heads 33 to 35 can be changed by rotating the head unit 30, and the head that was printing on the paper P can be cooled by the head cooling unit 40. Accordingly, ejection defects such as nozzle clogging can be suppressed from occurring in the head that was printing on the paper P by cooling that head, while continuing to printing on the paper P.

(2) The respective heads 33 to 35 can be made to face the head cooling unit 40 by rotation of the head unit 30. Thus, even when the temperature of any head out of the respective heads 33 to 35 has risen, the head having a raised temperature can be cooled by the head cooling unit 40, since all of the respective heads 33 to 35 can be cooled by the head cooling unit 40. Accordingly, ejection defects can be suppressed from occurring in the respective heads 33 to 35.

(3) Due to the head cooling unit 40 being positioned higher than the head unit 30, and due to the nozzles of the head facing the head cooling unit 40, from out of the respective heads 33 to 35, being open toward the upper side, the ink inside those nozzles forms a curved meniscus that is recessed inward toward the bottom due to its own weight. Thus, ink inside the nozzles of the head facing the head cooling unit 40 can be suppressed from depositing on the head cooling unit 40.

(4) Even when the supply flow paths 74C, 74M, 74Y, 74K have wound around the shaft 31 when the head unit 30, for example, has rotated in the clockwise direction, the wound supply flow paths 74C, 74M, 74Y, 74K can be restored to their former state by rotating the head unit 30 in the counterclockwise direction, since the head unit 30 can rotate about the shaft 31 in both directions. Thus, the supply flow paths 74C, 74M, 74Y, 74K can be prevented from becoming taut and hindering the rotation of the head unit 30.

(5) The efficiency of absorbing heat from the head housed in the cap 41 by the Peltier devices 42 can be increased due to the close contact through the elastic portion 43 of the head housed in the cap 41 of the head cooling unit 40, from out of the respective heads 33 to 35. Accordingly, the head housed in the cap 41 can be is rapidly cooled.

MODIFIED EXAMPLES

The exemplary embodiment above may be modified to obtain other exemplary embodiments, as follows.

In the heating section 13, an IR heater (infrared heater) that heats the paper P from the head unit 30 side may be employed instead of the flat heater. Essentially, it is sufficient for the heating section 13 to be configured capable of heating the paper P.

In the head unit 30, a fourth head may be provided to the head support section 32 in addition to the first head 33, the second head 34, and the third head 35. The number of heads may be set to five or more by forming the side face shape of the head support section 32 as a regular polygon having five or more sides. Moreover, the number of caps and the number of head cooling units 40 that perform maintenance on the heads can also be changed depending on the number of heads.

In the head unit 30, one head out of the first head 33, the second head 34, and the third head 35 may be omitted.

In the head unit 30, the side face shape of the head support section 32 may be changed to a regular triangle. In such cases, either the first cap 50 or the second cap 60 is omitted. Moreover, the first cap 50 and the second cap 60 may both be omitted.

The positions of the head cooling unit 40, the first cap 50, and the second cap 60 that do not face the respective heads 33 to 35 may be changed to the maintenance position (cooling position) along with the rotation of the head unit 30.

The head cooling unit 40 may be disposed at a position at the downstream side in the transport direction Y facing the head unit 30 along the transport direction Y, or in a position at the upstream side in the transport direction Y facing the head unit 30 along the transport direction Y. When changing the position of the head cooling unit 40, the first cap 50 and the second cap 60 may, for example, be disposed in positions higher than the head unit 30 and facing in the height direction Z.

The head cooling unit 40 may apply a cooling structure that uses air cooling or water cooling instead of the cooling structure that uses the Peltier devices 42. In cooling structures that use air cooling, the head housed in the cap 41 is cooled by cooling the cap 41 using, for example, a fan. In cooling structures that use water cooling, the head housed in the cap 41 is cooled by cooling the cap 41 by, for example, providing a pipe that circulates coolant water inside the cap 41. Essentially, it is sufficient for the head cooling unit 40 to be a structure capable of cooling the head housed in the cap 41 more rapidly than natural cooling.

At least one out of the first cap 50 or the second cap 60 may be changed to the head cooling unit 40.

Functionality for cleaning the heads facing the first cap 50 and the second cap 60 out of the respective heads 33 to 35 in the maintenance position may be added to the first cap 50 and the second cap 60. In such cases, for example, in a state of contact with the head facing the respective cap 50, 60 out of the respective heads 33 to 35, the first cap 50 and the second cap 60 perform cleaning by moving back and forth in the vertical direction with respect to the head.

At least one out of the first cap 50 or the second cap 60 may be omitted.

In the ink supply mechanism 70, the sub-tanks 72, 73 may be omitted.

In the head change processing, when the controller 81 changes the head that is printing on the paper P, the controller 81 may rotate the head unit 30 such that the head that was printing on the paper P before the change faces the head cooling unit 40. In such cases, the head printing on the paper P is rapidly cooled by the head cooling unit 40, enabling the threshold value of the temperature of the head in the head change processing (step S13) to be set to a higher temperature than the threshold value in the exemplary embodiment above. This enables the time taken to complete the print job to be reduced since the head printing on the paper P is changed fewer times.

In the head change processing, the controller 81 may omit either the determination as to whether or not there is an ejection defect in nozzles of the head printing on the paper (step S12), or the determination as to whether or not the temperature of the head printing on the paper is the threshold value or above (step S13).

The printing device 10 may be a multifunction device and is not limited to being configured to include just printing functionality.

The medium is not limited to the paper P, and may be a continuous sheet, a resin film, metal foil, a metal film, a composite film of resin and metal (a laminated film), a woven fabric, a non-woven fabric, a ceramic sheet, or the like.

The respective heads 33 to 35 may eject a liquid solution that does not include water as the liquid droplets (ink).

The liquid droplet ejecting apparatus may be a liquid droplet ejecting apparatus that sprays or ejects a liquid other than ink. Note that states of the liquid to be ejected as minute liquid droplets from the liquid droplet ejecting apparatus include granular shapes, teardrop shapes, and tadpole shapes. Moreover, it is sufficient for the liquid referred to here to be a material capable of being ejected from the liquid droplet ejecting apparatus. For example, a substance having a liquid phase form is sufficient, and examples of such substances include fluids such as high or low viscosity liquids, sols, aqueous gels, other inorganic solvents, organic solvents, solutions, liquid resins, and liquid metals (metal melts). Examples of such substances are not limited to substances in an exclusively liquid form, and further include solvents into which particles of a functional material, made from solid components such as pigments or metal particles, are dissolved, dispersed, or mixed. Typical examples of liquids include inks and liquid crystals. Here, inks encompass various liquid compositions, such as general water-based inks, oil-based inks, and gel inks, and hot melt inks. Specific examples of liquid droplet ejecting apparatuses include liquid droplet ejecting apparatuses that eject a liquid including a dispersed or dissolved form of a material such as an electrode material or colorant employed in, for example, manufacture of a liquid crystal display, an EL (electroluminescence) display, a surface light emission display, or a color filter. Moreover, the liquid droplet ejecting apparatus may be a liquid droplet ejecting apparatus that ejects a bioorganic material employed in biochip manufacture, a liquid droplet ejecting apparatus employed as a precise pipette that ejects a liquid as a sample, a textile printer, a micro disperser, or the like. Moreover, the liquid droplet ejecting apparatus may be a liquid droplet ejecting apparatus that ejects lubricating oil as a pin point onto a precision mechanism such as a camera or a clock, or a liquid droplet ejecting apparatus that ejects onto a substrate, a transparent resin liquid such as an ultraviolet curing resin for forming a hemisphere microlens (optical lens) employed in an optical communication element or the like. Moreover, the liquid droplet ejecting apparatus may be a liquid droplet ejecting apparatus that ejects an etching liquid such as an acid or an alkali for etching a substrate.

This application claims priority under 35 U.S.C. § 119 to Japanese Patent Application No. 2016-010392, filed Jan. 22, 2016. The entire disclosure of Japanese Patent Application No. 2016-010392 is hereby incorporated herein by reference.

What is claimed is:

1. A liquid droplet ejecting apparatus, comprising:

a heating section capable of heating a medium transported over a support platform;

a head unit that is disposed at a position facing the support platform with a gap therebetween, and that is capable of rotating about a rotation shaft extending along a direction intersecting a transport direction of the medium; and a head cooling unit capable of cooling the head unit, wherein:

the head unit is provided with a plurality of heads each include a nozzle capable of ejecting liquid droplets; and the heads are provided around a rotation direction of the head unit with gaps between one another, such that when one head out of the plurality of heads faces the medium, another head out of the plurality of heads can be made to face the head cooling unit, wherein:

the head cooling unit is disposed at a position higher than the head unit; and the nozzle of the head facing the head cooling unit is upwardly open.

2. The liquid droplet ejecting apparatus according to claim 1, wherein all of the plurality of heads can be made to face the head cooling unit by rotating the head unit.

3. The liquid droplet ejecting apparatus according to claim 1, further comprising:

a liquid supply source capable of supplying the liquid to the head unit; and a flexible supply flow path that connects the head unit to the liquid supply source, wherein the head unit is capable of rotating in both directions about the rotation shaft.

* * * * *